US008083166B2

(12) United States Patent
Gould et al.

(10) Patent No.: US 8,083,166 B2
(45) Date of Patent: Dec. 27, 2011

(54) ROOF SHINGLE STRIPPER, GRINDER, AND BLOWER

(76) Inventors: Jerry Francis Gould, Greene, PA (US); Vivian Jane Gould, Greene, PA (US)

( * ) Notice: Subject to any disclaimer, the term of this patent is extended or adjusted under 35 U.S.C. 154(b) by 152 days.

(21) Appl. No.: 12/683,408

(22) Filed: Jan. 6, 2010

(65) Prior Publication Data

US 2010/0212459 A1 Aug. 26, 2010

Related U.S. Application Data

(60) Provisional application No. 61/155,212, filed on Feb. 25, 2009.

(51) Int. Cl.
*B02C 19/00* (2006.01)

(52) U.S. Cl. ..... 241/101.77; 241/186.3; 241/222

(58) Field of Classification Search ..... 241/101.77, 241/186.3, 222, 236
See application file for complete search history.

(56) References Cited

U.S. PATENT DOCUMENTS

| | | | | |
|---|---|---|---|---|
| 4,767,067 | A * | 8/1988 | Bruer et al. | 241/81 |
| 4,938,425 | A * | 7/1990 | Williams et al. | 241/101.77 |
| 5,529,250 | A * | 6/1996 | Pallmann | 241/57 |
| 6,820,830 | B1 * | 11/2004 | Lassen et al. | 241/186.3 |
| 2003/0146317 | A1 * | 8/2003 | Faccia | 241/101.742 |
| 2004/0050987 | A1 * | 3/2004 | Rossi, Jr. | 241/101.77 |
| 2010/0032508 | A1 * | 2/2010 | Post et al. | 241/88.4 |

* cited by examiner

*Primary Examiner* — Faye Francis
(74) *Attorney, Agent, or Firm* — Larry E. Severin

(57) ABSTRACT

A roof shingle stripper, grinder, and blower includes: a motor to power the device; self-propelled wheels that move the device forward and urge the shingles into the device; a lifting blade that lifts up and dislodges the shingles from the roof; a shredder having two rows of grinding wheels that grind the shingles into pieces and blow the pieces into a conduit; and the conduit has a side wall that, when the wall is in a first position, diverts the pieces in a first direction, and when the wall is in a second position, diverts the pieces in a second direction.

16 Claims, 4 Drawing Sheets

ROOF SHINGLE STRIPPER, GRINDER, AND BLOWER

RELATED APPLICATIONS

This application claims the benefit of the filing date of U.S. Patent Application No. 61/155,212, filed Feb. 25, 2009, which is incorporated herein by reference in its entirety.

BACKGROUND OF THE INVENTION

The present invention generally relates to roofing and more specifically to a roof shingle stripper, grinder, and blower.

It takes many men to remove the shingles from a roof, and it becomes a very messy job on the roof and ground being a costly project.

It would be desirable to have a device for removing shingles from a roof.

SUMMARY OF THE INVENTION

In one aspect of the present invention, a device for collecting debris includes: a shredder; a lifting blade that lifts the debris and provides the debris to the shredder; self-propelled wheels to move the device forward; a motor to power the shredder, the lifting blade, and the wheels; a wall that transitions between a first position and a second position; and a conduit having a first output and a second output; wherein when the wall is in the first position, the conduit channels the debris to the first output, and when the wall is in the second position, the conduit channels the debris to the second output, thereby collecting the debris.

In another aspect of the present invention, a device for removing shingles from a roof includes: a motor to power the device; self-propelled wheels that move the device forward and urge the shingles into the device; a lifting blade that lifts up and dislodges the shingles from the roof; a shredder having two rows of grinding wheels that grind the shingles into pieces and blow the pieces into a conduit; and the conduit has a side wall that, when the wall is in a first position, diverts the pieces in a first direction, and when the wall is in a second position, diverts the pieces in a second direction.

In yet another aspect of the present invention, a method of collecting debris includes: propelling a collector forward so as to receive the debris; utilizing a lifting blade to lift the debris into the collector; utilizing a shredder to shred the debris; providing the shredded debris to a conduit in a first direction; and utilizing a wall of the conduit having a first position that channels the debris in a second direction generally perpendicular to the first direction; thereby collecting the debris.

DETAILED DESCRIPTION

Figure 1:
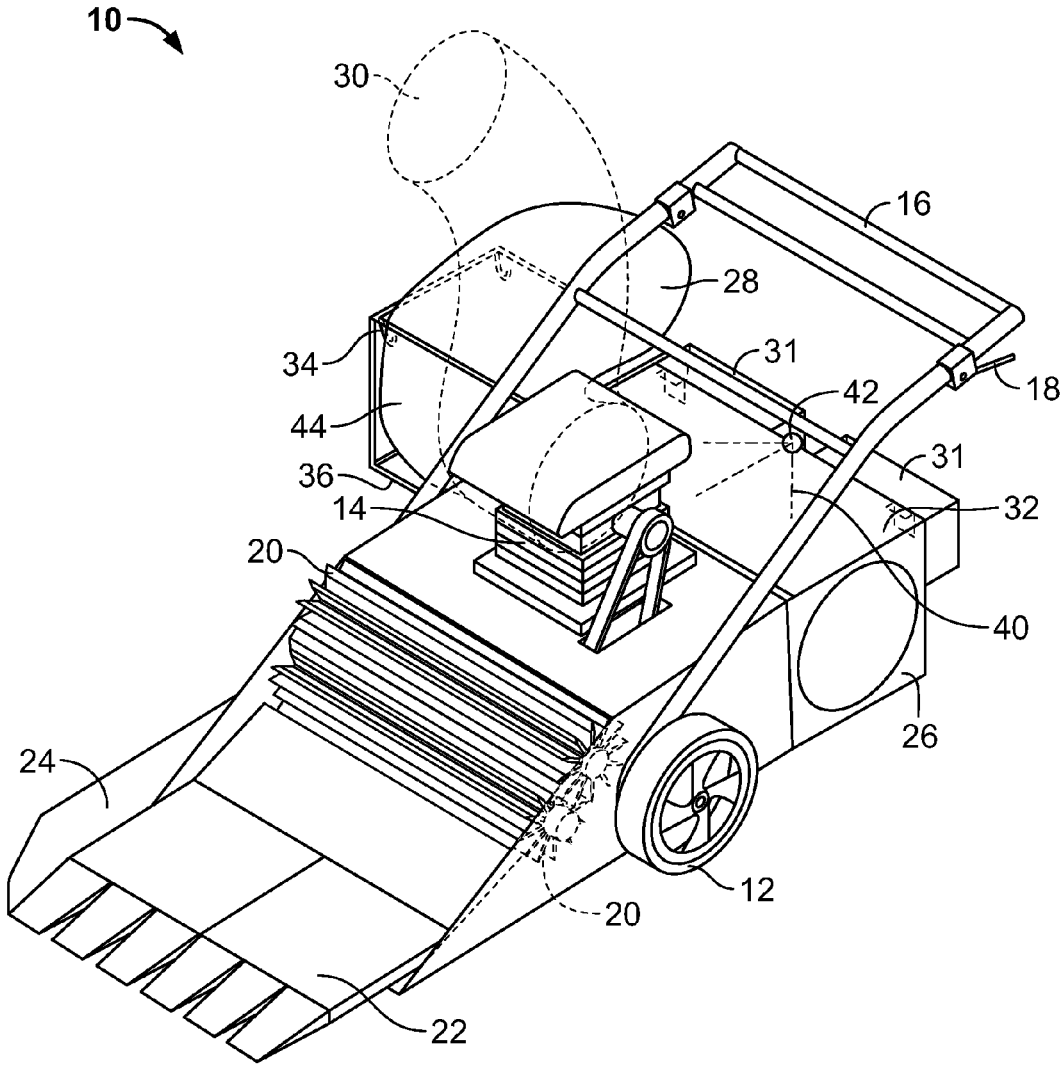
FIG. 1 is a perspective view of an embodiment of the invention.
Figure 2:
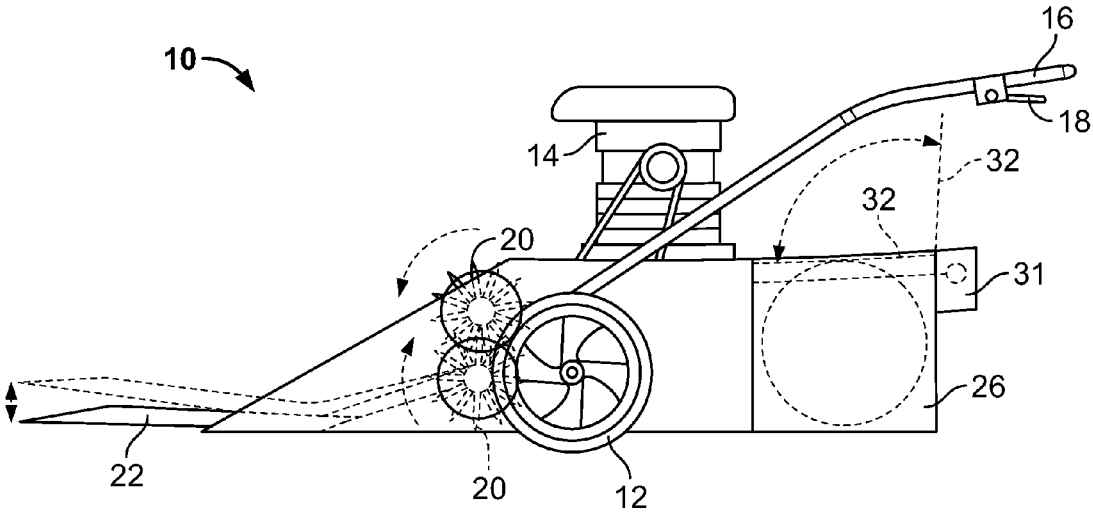
FIG. 2 is a side view of an embodiment of the invention.
Figure 3:
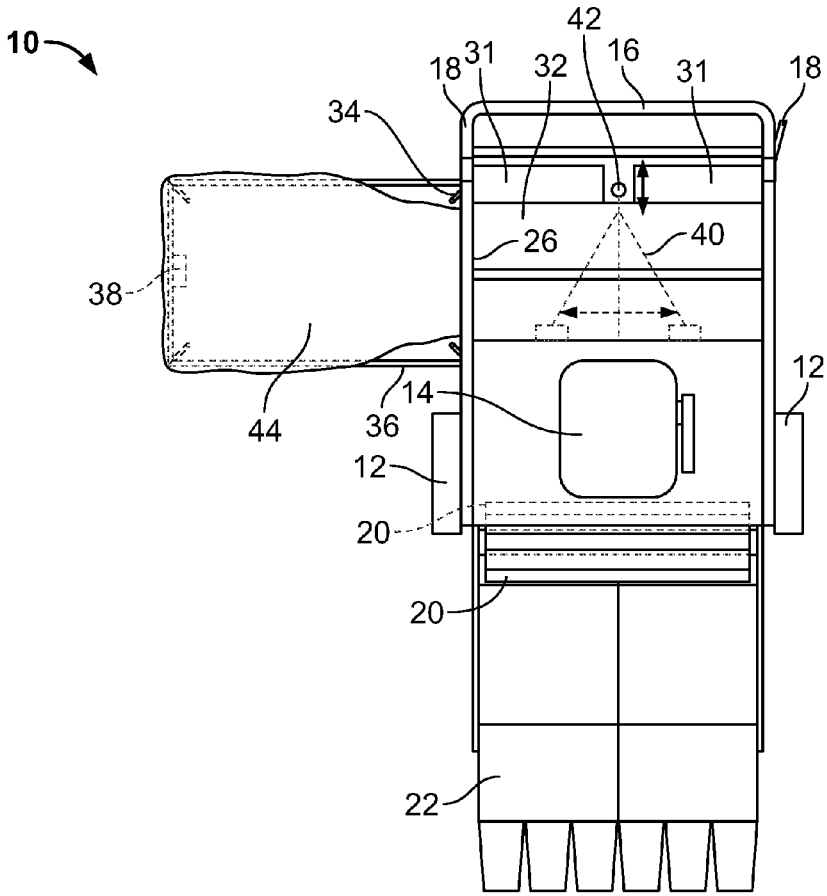
FIG. 3 is a top view of an embodiment of the invention.
Figure 4:
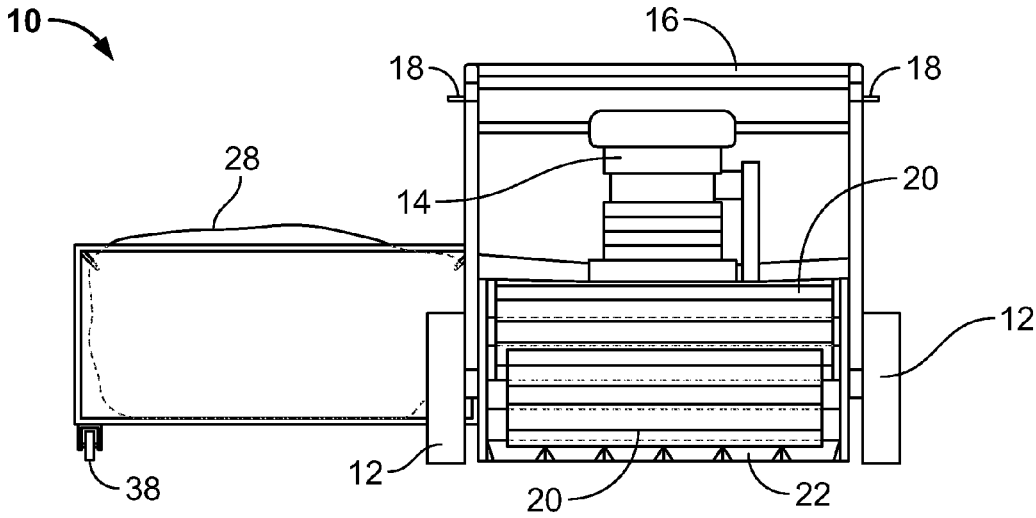
FIG. 4 is a front view of an embodiment of the invention.

The preferred embodiment and other embodiments, including the best mode of carrying out the invention, are hereby described in detail with reference to the drawings. Further embodiments, features and advantages will become apparent from the ensuing description or may be learned without undue experimentation. The figures are not drawn to scale, except where otherwise indicated. The following description of embodiments, even if phrased in terms of "the invention," is not to be taken in a limiting sense, but describes the manner and process of making and using the invention. The coverage of this patent will be described in the claims. The order in which steps are listed in the claims does not indicate that the steps must be performed in that order.

An embodiment of the present invention generally provides a roof shingle stripper, grinder, and blower. This may include a device that strips shingles off a roof, grinds the shingles up into tiny pieces, and blows the pieces into a bag attached to the stripper for removal. An embodiment takes one person to perform the work. It keeps the project clean and safe, as well as performing the work in half of the time.

As depicted in the FIGS. 1, 2, 3, and 4, an embodiment of the present invention 10 may include self-propelled wheels 12, driven by a gas motor 14. A handle 16 for driving the device holds levers 18 to control the motor 14. Grinding wheels 20 are fed by a lifting blade 22 with a guard 24. A box 26, which is a square tube or other conduit, retains a bag 28 or a flexible hose 30. Inside the box 26, an adjustable side wall 40 diverts the debris to the side. Adjustable side wall 40 may be adjusted with a knob 42 to output the debris to either side. A magnetic box 31 may catch nails or staples. A hinged clean out lid 32 allows access to on the box 26. In an embodiment, a removable bag rack basket 36 or frame has bag hooks 34 to hold the bag 28, plus a wheel 38 on the outside of the frame.

An embodiment may lift up and dislodge shingles from a residential or commercial roof that has been either nailed or stapled down. The slopes may range from a ½"/12 pitch to a 5"/12 pitch roof. When the roof sloop exceeds 5"/12 pitch, this machine may have a "U" shape hook that is attached to both sides of the machine to stabilize it on the roof for safety. The machine then may have a pulley with a rope attached to the machine on either side.

In an embodiment, once the shingles are lifted from the plywood roof, the shingles are forced back into a double wheel shedder or grinder that breaks the shingles into tiny pieces. Once the shingles go through the grinding wheels, they are blown out by force of the double wheel into a catch bag or flexible hose, mounted to aluminum tubing mounted to the side of the machine.

In an embodiment, the square aluminum box 26 has two directions in which the debris may be forced out. There is a moveable side wall 42 that may be changed from the right to the left depending on the direction the operator is moving the machine. This may be altered in direction, utilizing a knob 42 near the rear of the aluminum box 26. The side wall 42 locks into place, and will deflect and output debris ground up by the grinding wheels 20 to the left or right side of the machine.

In an embodiment, behind the aluminum box 26 is a magnet container 31 that will pull the nails or staples into a box. This will separate the ground-up shingles from the metal fasteners, so that the debris is recyclable waste. Since an embodiment is a self propelled machine, so it does not require pushing or pulling to perform the operation of removing, grinding and blowing the pieces into the holding bag.

An embodiment of this machine may come as three pieces: the stripper machine, the frame for the catch bag, and the catch bag. The machine may be loaded to the roof by two different methods: a belt escalator that reaches to the eave of a roof, or it may be carried up a ladder to reaches the roof. Once the machine is on the roof, the operator may assemble the parts of the machine.

In an embodiment, a removable frame 36 may be attached on the right or left side (depending on the direction the operator is going to move). The machine 10 may include two extensions of 1½" length bars, which the frame may be placed over to hold into place. The wheel 38 on the outside of the frame 36 sustains the frame parallel to the slope of the roof as the machine goes across the roof. A pin may be pushed through a hole to lock the frame (into place.

Figure 5:
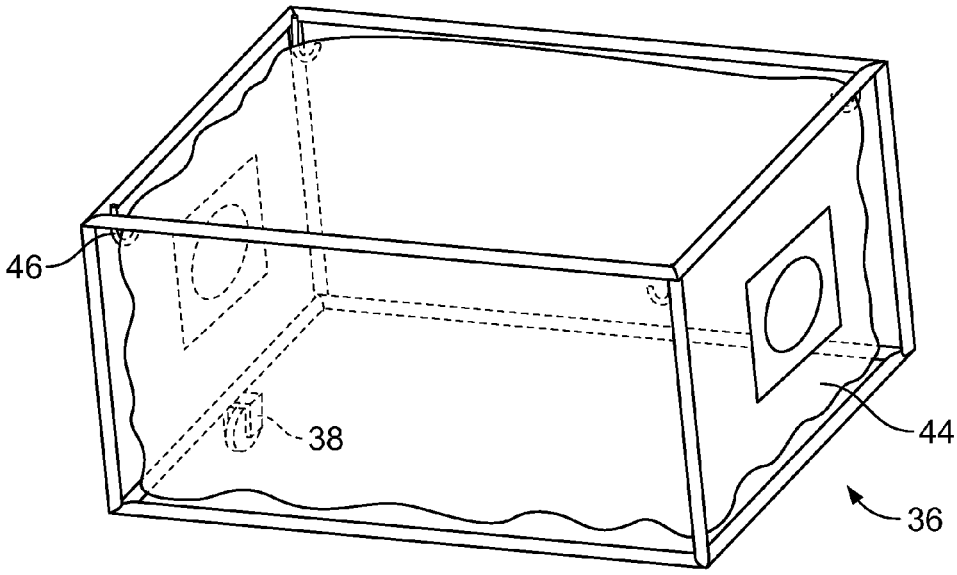
FIG. 5 is depicts an embodiment of a bag frame according to the present invention.

As depicted in the embodiment of FIG. 5, when an embodiment of a bag frame 36 is mounted to the two extended bars and in place, the bag 44 may then be placed inside the frame 36. The frame 36 has four hooks 46, and the bag 44 has four metal eyes that is hook to the frame. This stabilizes the bag from falling out once the bag is being filled with recycle debris from the roof.

Figure 6:
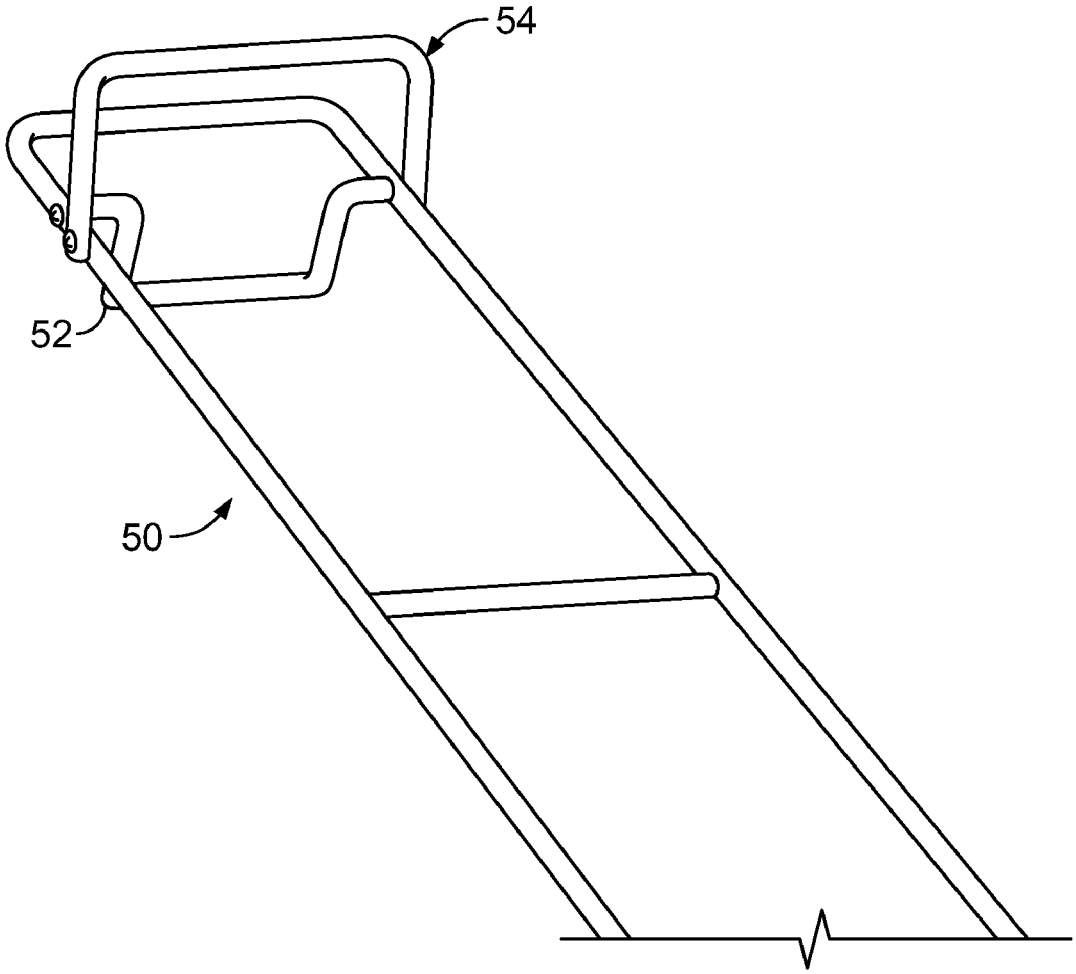
FIG. 6 depicts an embodiment of a handle according to the present invention.

As depicted in FIG. 6, an embodiment of a handle 50 includes a bottom bar 52 to control the wheels and a top bar 54 to control the grinder and lift blades. The bars 52, 54 are parallel to the handle 50 and go across the machine. To start the machine the top bar 54 is held down to the handle allowing the engine to be in the neutral position. There may be a clear rubber prime button on the front of the engine that should be pushed 3 times to prime the engine. Once the button has been pushed, a pull rope is pulled to start engine. If the engine does not start, repeat the process. After the start of the engine, the top bar 54 operates the lifting of the lifting blade 22 in front of the machine, and starts the grinding wheels 20 and turning of the self-propelled wheels 12. To stop the forward motion of the machine, release the bottom bar 52 on the handle.

In an embodiment, if the machine grinding cylinders become clogged or there is a back up in the aluminum box, a lid 32 that may be lifted for cleaning and repair of the grinding wheels 20. This lid 32 may allow a cleaning periodically for good maintenance of the machine.

In an embodiment, once the bag is ⅔ filled, the bag may be released from the hooks that has held it in place and emptied in two ways: dumped into dump truck, or recycle debris is dumped into a bag and placed into a dump truck or a pick-up truck. After the bag is emptied it may be placed back into the rack and the engine may be restarted by following the above process.

An embodiment is a machine which is light weight with two small wheels that is self propelled. The motor is a gas machine that is light weight and small in size, that may be started by a pull rope. On the handle of the machine are two levers which activate the self propelling wheels and the grinding wheels. The machine has a blade that sticks out about 12" that is about 24" wide. The blade lifts up about 2" to break the shingles loose. On the side of the removing blade is a metal or plastic guard that may be repositioned on the right or left of the lifting blade, keeping the shingles from falling off the machine. The self propelled machine forces the shingles into a grinding wheel that blows the shingles through a square tube. On the side of the tube may be a canvas plastic bag attached to the machine that will receive the grounded up debris of shingles in tiny pieces. The rack that holds the bags may be repositioned to the right or left side of the machine for convenience. The bag may either be tied if it is a plastic bag or thrown away, or a canvas bag can be empty into a dump truck. This may keep the project clean with one person performing the work in half the time.

In an embodiment, the lifting plates are from 12" 28" wide. The grinder is two drums with cutting blades that are 2½" long for grinding the shingles. The grinder spins by a belt or chain that will blow the shingles through an aluminum square tube that is about 8" by 8" into a bag. The bag holder may be an aluminum rod about ¼" to ½" depending on the size of bag desired to use. The side blade that keeps the shingles from falling off may be 2½" by 26" and may be attached to a ¼" rod that may snap into a hole on either the right or left side of the blade in front of the machine. The front blade on the side of the cutting blade may be moved from the right side or to the left side. The bag where the shingles are blown in may also be moved from the right to left side.

We claim:

1. A device for collecting debris, comprising:
a shredder;
a lifting blade that lifts the debris and provides the debris to the shredder;
self-propelled wheels to move the device forward;
a motor to power the shredder, the lifting blade, and the wheels;
a wall that transitions between a first position and a second position; and
a conduit having a first output and a second output;
wherein when the wall is in the first position, the conduit channels the debris to the first output, and when the wall is in the second position, the conduit channels the debris to the second output, thereby collecting the debris.

2. The device of claim 1, further comprising:
a handle to steer the device; and
controls on the handle to control the shredder, the lifting blade, and the wheels.

3. The device of claim 1, further comprising:
a handle to steer the device;
a first bar to control the self-propelled wheels that operates when the first bar is held toward the handle and stops when the first bar is released; and
a second bar to control the shredder and the lifting blade that operates when the second bar is held toward the handle and stops when the second bar is released.

4. The device of claim 1, wherein the shredder provides the debris to the conduit in a first direction and the conduit outputs the debris in a second direction that is generally perpendicular to the first direction.

5. The device of claim 1, further comprising:
a bag adapted to releasably attach to the first output of the conduit and to releasably attach to the second output of the conduit; and
a wheel to help support the bag;
wherein, when the wall is in the first position and the bag is attached to the first output, the conduit outputs the debris to the bag, and when the wall is in the second position and the bag is attached to the second output, the conduit outputs the debris to the bag.

6. The device of claim 5, further comprising:
a frame to releasably attach to the device and support the bag.

7. The device of claim 1, wherein the debris is a shingle of a roof and the lifting blade is adapted to lift up and dislodge the shingle from the roof.

8. The device of claim 1, wherein the shredder includes two rows of grinding wheels that grind the debris and then blows the debris into the conduit.

9. The device of claim 1, further comprising:
a knob to transition the wall between the first position and the second position.

10. The device of claim 1, further comprising:
a catch box; and
a magnet;

wherein the magnet is adapted to separate metal from the debris and urge the metal into the catch box.

11. The device of claim 1, wherein the debris includes wooden roof shingles, further comprising:

a magnetic catch box;

wherein the magnetic catch box removes magnetic materials from the debris so that the device collects biodegradable debris.

12. The device of claim 1, further comprising:

a guard to help urge the debris to the lifting blade.

13. A device for removing shingles from a roof, comprising:

a motor to power the device;

self-propelled wheels that move the device forward and urge the shingles into the device;

a lifting blade that lifts up and dislodges the shingles from the roof;

a shredder having two rows of grinding wheels that grind the shingles into pieces and blow the pieces into a conduit; and the conduit has a side wall that, when the wall is in a first position, diverts the pieces in a first direction, and when the wall is in a second position, diverts the pieces in a second direction.

14. The device of claim 13, further comprising:

a handle to steer the device;

controls on the handle to control the shredder, the lifting blade, and the wheels; and a knob to transition the wall between the first position and the second position.

15. The device of claim 13, further comprising:

a removable frame for a bag, the frame adapted to attach to a first side of the device so the bag collects pieces diverted in the first direction, the frame further adapted to attach to a second side of the device so the bag collects pieces diverted in the second direction.

16. The device of claim 13, further comprising:

a magnetic catch box adapted to remove magnetic materials from the pieces.

* * * * *